United States Patent [19]

Shaw

[11] 4,297,955

[45] Nov. 3, 1981

[54] SEWING APPARATUS

[76] Inventor: Edward W. Shaw, 11735 Joseph Casavant, Montreal, Quebec, Canada, H3M 2B9

[21] Appl. No.: 73,608

[22] Filed: Sep. 10, 1979

[30] Foreign Application Priority Data

Nov. 18, 1978 [GB] United Kingdom ..... 45156/78

[51] Int. Cl.[3] ..... D05B 21/00

[52] U.S. Cl. ..... 112/121.15; 112/308

[58] Field of Search ..... 112/121.15, 121.11, 112/121.12, 121.29, 308, 309, 121.14

[56] References Cited

U.S. PATENT DOCUMENTS

| | | | |
|---|---|---|---|
| 2,939,414 | 6/1960 | Slinn | 112/308 |
| 3,072,081 | 1/1963 | Milligan et al. | 112/308 X |
| 3,329,109 | 7/1967 | Portnoff et al. | 112/308 X |
| 3,349,713 | 10/1967 | Bono | 112/121.12 |
| 4,069,778 | 1/1978 | Kozawa | 112/121.12 |

*Primary Examiner*—H. Hampton Hunter

*Attorney, Agent, or Firm*—McFadden, Fincham & Co.

[57] ABSTRACT

An apparatus for use in automatically sewing articles along a symmetrical, open-ended path. The articles can be sewn from either end of the path. The apparatus employs a cam means which corresponds to the open-ended path and control and operating means for automatically driving the cam means in either direction.

15 Claims, 16 Drawing Figures

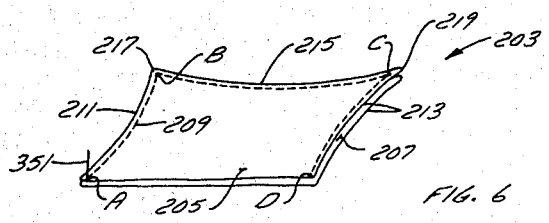
FIG. 6
FIG. 15A
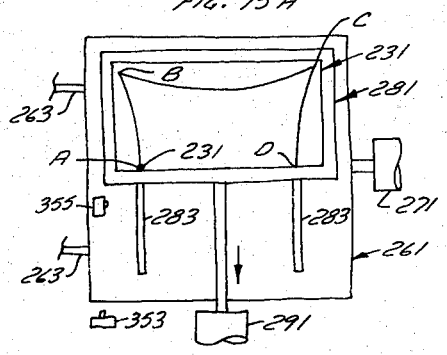
FIG. 15B
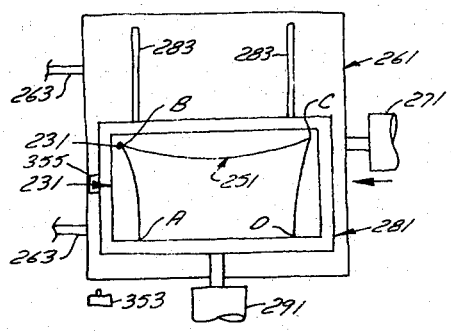
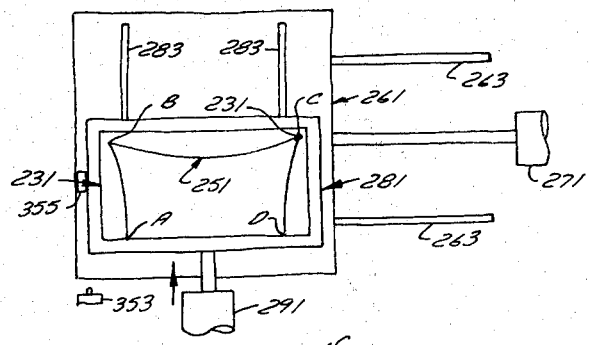
FIG. 15C
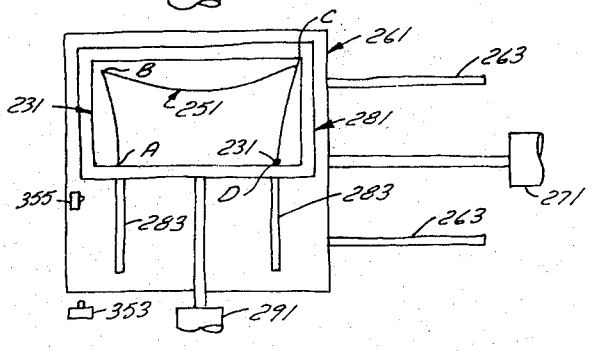
FIG. 15D

SEWING APPARATUS

This invention is directed toward an apparatus for use in automatically sewing articles.

The invention is more particularly directed toward an apparatus and components of the apparatus, for use in automatically sewing articles along a symmetrical, open-ended path whereby the articles can be sewn from either end of the path.

The sewing of piecework articles such as collars and collar bands is very time consuming, due to the handling involved. It is known to provide holder means for the articles which holder means can be rapidly guided past a sewing machine needle to sew the article. For fast sewing machines it is known to guide the holder automatically past the sewing machine needle. However the guide means must always be returned to an initial start position ready for the next article to be sewn. This return step slows down the operation and increases wear of the machine.

It is the purpose of the present invention to provide an apparatus for use in automatically sewing articles which apparatus permits an increase in output, while reducing wear of the machine. It is another purpose of the present invention to provide an apparatus for automatically sewing articles which is fast in operation, simple in construction, and easy to operate. It is a further purpose to provide an apparatus which can be easily adapted to any existing sewing machine, requiring a minimum amount of space.

In accordance with the present invention, there is provided a guide mechanism for use in sewing articles which guide mechanism allows the articles to be automatically sewn from either end of a symmetrical open-ended sewing path. The advantages of this is that the guide mechanism can sew a first article from left to right past a sewing needle, and then, without moving to return the mechanism, a second identical article can be sewn back from right to left. Thus more efficient utilization of the machine is obtained.

The invention is particularly directed toward an apparatus for use in substantially automatically sewing articles along a symmetrical, open-ended path which apparatus comprises means for mounting each article on a support and means for automatically moving the support to sew along the path from either end of the path to the other end.

The invention will now be described in detail having reference to the accompanying drawings in which:

FIG. 6 is a perspective view of a collar;

Figure 16:
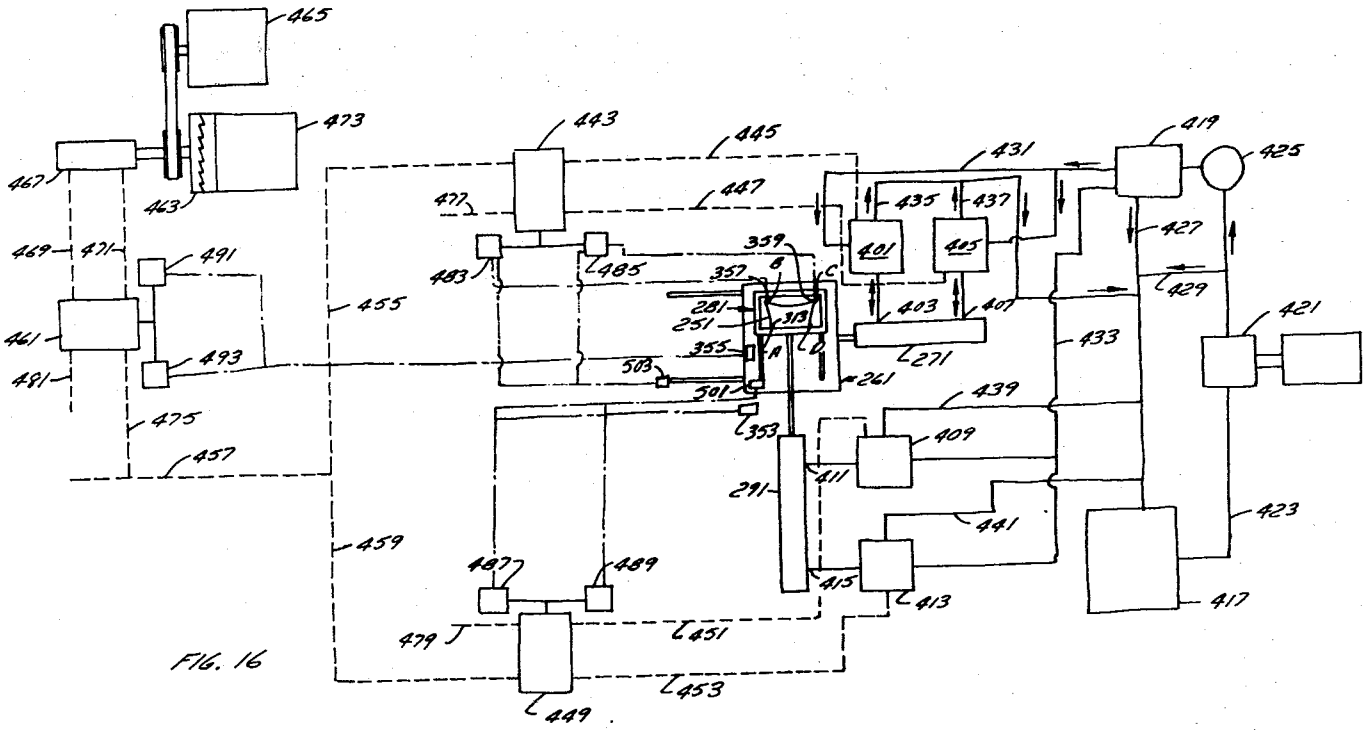

FIG. 15 appearing on the same sheet as FIG. 6 is a schematic set of views showing the operation of the apparatus;

FIG. 16 is a schematic view of one type of operating control means for the apparatus.

Figure 1:
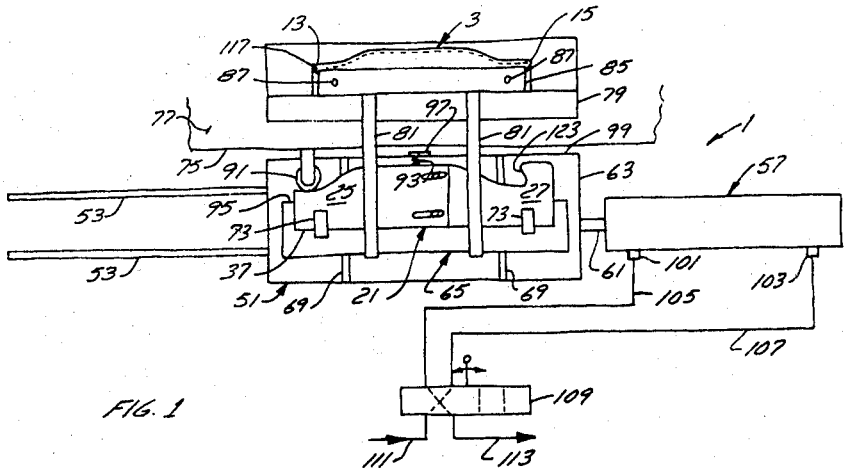
FIG. 1 is a plan view of apparatus for use in sewing collar bands.
Figure 2:
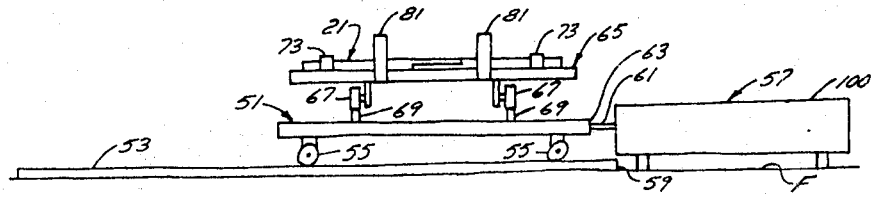
FIG. 2 is a front view of the apparatus.
Figure 3:
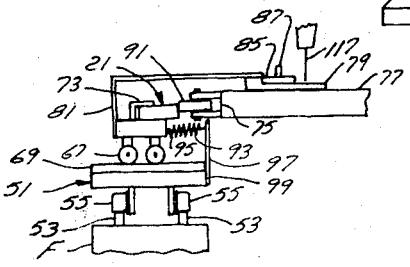
FIG. 3 is a side elevation view of the apparatus.
Figure 4:
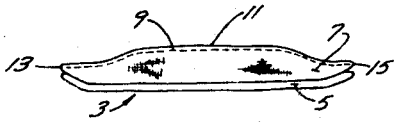
FIG. 4 is a perspective view of a collar band.

The apparatus 1 shown in FIGS. 1 to 3 is for use in automatically sewing articles with a sewing machine along a relatively straight, symmetrical, open-ended path. Such an article by way of example, can be a collar band 3, as shown in FIG. 4. The collar band 3 comprises two or more plies 5, 7 of fabric which plies are to be sewn together along a path 9 adjacent one edge 11 of the plies. The edges 11 are relatively straight and symmetrical between the ends 13, 15 of the plies.

Figure 5:
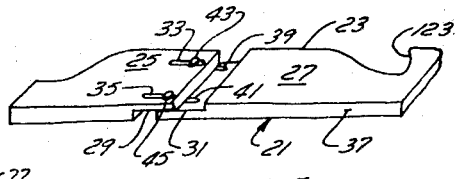
FIG. 5 is a perspective view of the template used to sew a collar band.

The apparatus 1 employed for use in sewing the collar bands 3 includes a thin, generally rectangular-shaped template member 21, shown in FIG. 5, which carries a symmetrical open-ended cam guide surface corresponding to the path along which the bands are to be sewn. In this apparatus, the cam guide surface is defined by the inner edge 23 of template which edge is shaped to the desired sewing path. The template 21 can be made in one piece. Preferably, however, it is made in two pieces 25, 27 which pieces overlap. The degree of overlap can be adjusted to adjust the length of edge 23 so that bands of different length can be sewn. As shown more clearly in FIG. 5, one template piece 25 has a top portion 29 at one side which overlaps a bottom portion 31 on the other template piece 27. A pair of spaced-apart locating slots 33, 35 are provided in the top portion 29 of piece 25 extending generally parallel to outer straight edge 37 of template 21. A corresponding pair of spaced-apart slots 39, 41 are provided in the bottom portion 31 of piece 27 also extending generally parallel to outer edge 35. A bolt 43 extends through aligned slots 33, 39 and a bolt 45 extends through aligned slots 35, 41. With bolts 43, 45 loosened, template pieces 25, 27 can be adjusted to obtain the desired length of the sewing path. When the desired length is obtained, the bolts 43, 45 are then tightened to lock the pieces 25, 27 tightly together.

The guiding apparatus 1 includes a first support member or platform 51. This platform member 51 is movably mounted on a pair of straight rails 53 which rails are adapted to be mounted directly or indirectly on the frame "F" of a sewing machine. The platform 51 comprises a generally rectangular member having wheels 55 on its bottom surface which run on the rails 53. Means are provided for moving the first platform 51 back and forth in a straight line along the rails 53. These means can comprise a fluid-operated piston and cylinder device 57 mounted on the sewing machine frame adjacent one end 59 of the rails 53. The free projecting end of the piston rod 61 of the fluid-operated device 57 is fixed to one side 63 of the first platform 51. The device 57 is substantially parallel with the rails 53.

A second support member or platform 65 is movably mounted on the first platform 51 for movement in a straight line perpendicular to the straight line movement of the first platform 51. The second platform 65 also comprises a generally rectangular member having wheels 67 on its bottom surface which run on a pair of straight rails 69 mounted on the top side of platform 51. The rails 69 extend perpendicular to the rails 53.

Suitable clamping means 73 are provided on the top side of the second platform 65 to detachably clamp the template 21, adjacent its straight side 37, to the second platform 65. The template 21 can project inwardly toward a sewing machine from the second platform 65 with its cam surface 23 located adjacent the front edge 75 of a sewing machine work table 77. A collar band holder support 79 is also mounted on the second platform 65. The holder support 79 is fixed to the second platform 65 by a pair of arms 81 extending over the template 21 and onto the sewing machine work table 77 to position the holder support 79 flush against the work table 77. A collar band holder 85, carrying the collar band 3 to be sewn, is detachably mounted via locating pins 87 on the holder support 79.

Cam means are fixedly mounted on the sewing machine to cooperate with the cam surface 23. The cam means preferably comprise a roller 91 which is preferably mounted on edge 75 of the work table 77 to project outwardly against the template cam surface 23. Spring means are provided to continuously bias cam surface 23 against fixed roller 91. The spring means can comprise a tension spring 93 fixed at one end to the inner edge 95 of the second platform 65, midway between rails 69; and at its other end to a post 97 fixed to the inner edge 99 of the first platform 51.

The fluid-operated device 57 can comprise an air cylinder 100 having a front port 101 and a rear port 103. Lines 105, 107 connect ports 101, 103 respectively, to a manually operated control valve 109, which in turn is connected via lines 111, 113 to a source of pressurized air (not shown), and atmosphere, respectively. Suitable switches (not shown) can be provided to control operation of the sewing machine. The switches can be located on rails 53, operated by movement of the first platform 51, or they can be located in other suitable areas.

In operation, a band 3 to be sewn along path 9 is loaded into a holder 85 which holder is then detachably mounted in the holder support 79. The fluid device 57 is in its retracted position and the holder support 79 positions the band so as to move the sewing machine needle 117 located at the left end 13 of the path 9. The valve 109 is now actuated to feed pressurized air from line 111 to port 103 of device 57 via line 107 and to exhaust air from port 101 via lines 105 and 113. The first platform 51 is now moved from right to left, viewing FIG. 1. Initial movement of the first platform initiates operation of the sewing machine by suitable means. During the right-to-left movement, the second platform 65 moves toward or away from the sewing machine table 77 as the contoured cam edge 23 on the template is pushed past the roller 91, the spring 93 continually biasing the second platform 65 toward the table. When the other end 15 of the path 9 reaches the sewing machine needle 117, the sewing machine is stopped by suitable switch means. Movement of the first platform 51 is also stopped by providing a stop 123 on the template 21 at the end of cam edge 23 adjacent the fluid device 57. The stop 123 catches roller 91 and halts further movement. At this stage, the holder 85 with the now sewn band is removed and a new holder containing a second band to be sewn is placed in the holder support 79. Valve 109 is now again manually actuated in the reverse direction to feed pressurized air to port 101 and exhaust air from port 103 causing the first platform 51 to now move from left to right, viewing FIG. 1, and to operate the sewing machine to sew the second band from end 13 to end 15 along path 9. Reaching end 15 the fluid device 57 ends its stroke, sewing stops, and the second band, now sewn, is removed. The machine is now ready to sew a third band back from right to left.

It will be seen that a very simple, very fast apparatus has been provided for sewing along relatively straight, symmetrical, open-ended paths. The apparatus does not need to be returned to its start position after each sewing apparatus in order to sew another article, which would waste time and increase wear. Instead the apparatus permits a band to be sewn in each direction of movement.

The apparatus described above is well suited for sewing articles along a relatively straight path. However, if the path deviates substantially from a straight path, it is preferred to replace the spring means with a second fluid-operated device in order to obtain faster, more positive, movement. For example, a shirt collar has sharply defined corners or points which a roller cam could not accurately traverse on a template. It is therefore preferred to modify the apparatus shown in FIGS. 1 to 3 by providing a second fluid-operated device to move the second platfom, in place of the roller cam and spring means. In addition, the template and the operating means are modified to obtain fast, automatic sewing.

An apparatus 201 suitable for sewing shirt collars 203 is shown in FIGS. 7 to 14. The shirt collars 203 to be sewn, shown in FIG. 6, comprise two or more fabric layers 205, 207, cut in the shape shown and adapted to be sewn together along a symmetrical, open-ended path 209 which is close to, and parallels, the side edges 211, 213 and the outer edge 215 of the collar. The side edges 211, 13 are slightly concave. The outer edge 215 is also slightly concave and longer than the side edges 211, 213. The outer edge 215 meets the side edges 211, 213 at the collar points 217, 219. The sewn path 209 follows closely adjacent to edges 211, 213, 215 starting from one end A to a first corner B, adjacent collar point 217, to a second corner C adjacent collar point 219, and to the other end D.

Figure 10:
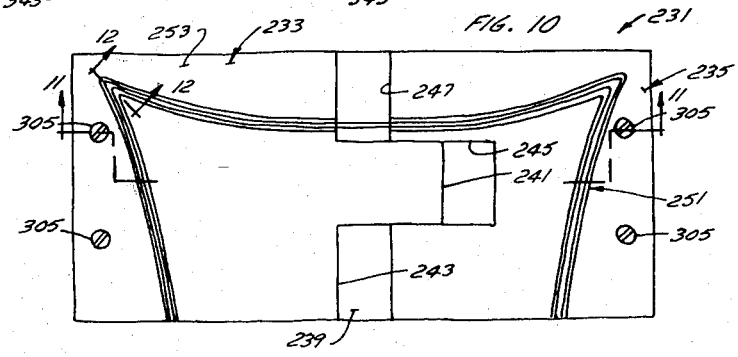
FIG. 10 is a plan view of the collar template.
Figure 11:
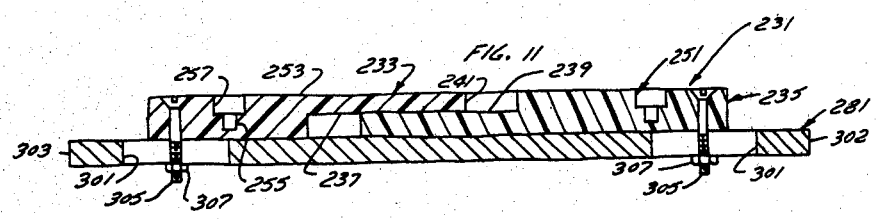
FIG. 11 is a cross-section view taken along lines 11—11 of FIG. 10.

The apparatus 201 for use in sewing collars 203 includes a template member 231 which carries symmetrical, open-ended cam guide means corresponding to the path 209 along which the collar is to be sewn. The template 231 can be made in one piece. Preferably, however, it is made in two pieces 233, 235 as shown in FIGS. 10 and 11 which pieces can be moved toward or away from each other to adjust the size of the template 231. One piece 233 has a top portion 237 extending from one side which overlaps a bottom portion 239 extending from the adjacent side of the other piece 235. In addition, the top portion 237 has a rectangular "tongue" section 241 projecting outwardly from the center of its free side 243 which section slides in a mating groove 245 formed in piece 235 extending inwardly from the inner side 247 of the bottom overlap portion 239. The tongue and groove arrangement guide the template pieces 233, 235 in their movement toward or away from each other.

The template 231 carries a cam guide groove 251 which corresponds to the path 209 to be sewn. The groove 251 is cut into the upper surface 253 of the template pieces, and preferably comprises a two-level groove having a deep narrow portion 255 and a wider upper portion 257. The wider upper portion 257 has a depth substantially equal to the thickness of the top overlap portion 237.

Figure 7:
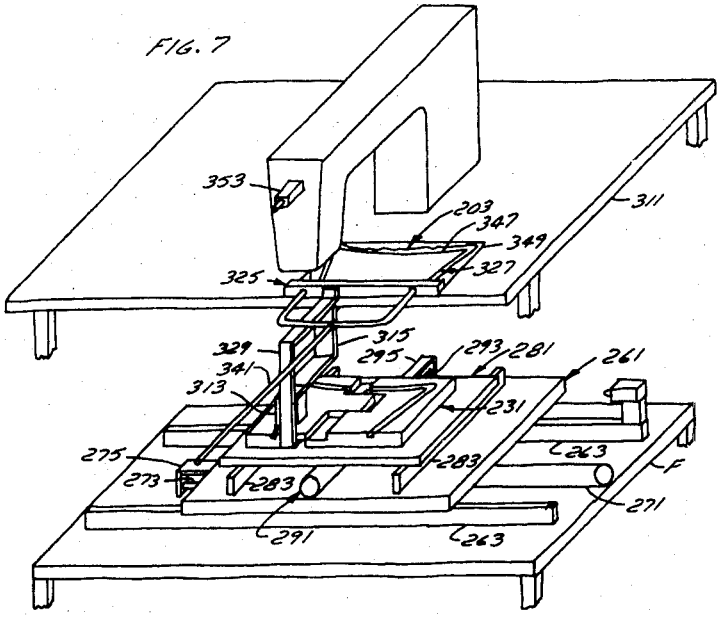
FIG. 7 is a perspective view of apparatus for use in sewing a collar.
Figure 8:
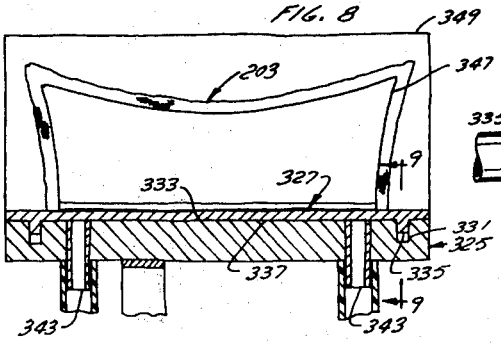
FIG. 8 is a plan view, in partial section, of a collar support and a collar support holder.
Figure 9:
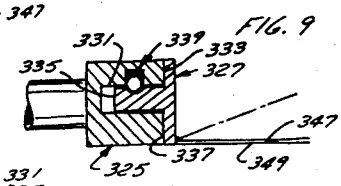
FIG. 9 is a cross-section view taken along line 9—9 of FIG. 8.
Figure 13:
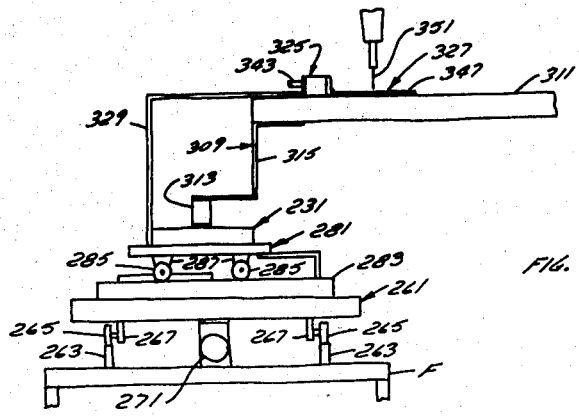
FIG. 13 is an end elevation view of the apparatus.
Figure 14:
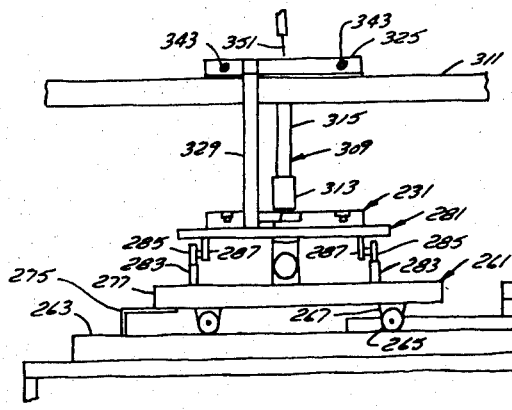
FIG. 14 is a front elevation view of the apparatus.

The apparatus 201 includes as shown in FIGS. 7, 13 and 14, a first support member or platform 261. This first platform 261 comprises a generally rectangular member which is adapted to be movably mounted on a pair of straight rails 263 fastened directly or indirectly to the frame "F" of a sewing machine. The first platform 261 has wheels 265 on brackets 267 which depend from its bottom surface. The wheels 265 run on the rails 263. Means are provided for moving the first platform 261 back and forth along the rails 263. These means can comprise a first fluid-operated piston and cylinder device 271. The fluid-operated device 271 is fixed to the sewing machine frame at one end of the rails. The fluid device 271 can be located beneath the first platform 261, extending parallel to rails 263, and has the free end of its piston rod 273 fixed to a bracket 275 which is attached to one side 277 of first platform 261.

A second support member or platform 281 is mounted on top of the first platform 261. A pair of straight rails 283 are provided on the top surface of platform 261, extending perpendicular to the first rails 263. Second platform 281 has wheels 285 mounted on brackets 287 which depend down from the bottom surface of the platform. The wheels 285 run on the rails 283. Means are provided for moving the second platform 281 back and forth along the rails 283. These moving means comprise a second fluid-operated piston and cylinder device 291. This device 291 is fixed to the first platform between rails 283 and extends under the second platform parallel to rails 283. The free end of the piston rod 293 of the second device is fixed to a bracket 295 which bracket is fixed to the side 297 of the second platform 281. Second fluid-operated device 291 extends perpendicular to the first device 271.

The template 231 is detachably mounted on the top surface of second platform 281, with the template pieces 233, 235 movable toward and away from each other in a line generally parallel to bottom rails 263. Elongated slots 301 are provided in second platform 281, parallel to rails 236. More particularly, a pair of slots 301 are provided near each side edge 302, 303 of the platform. Each template piece carries a pair of bolts 305 for fitting in the slots at either side of the platform. Nuts 307 attach to the bolts 305. When nuts 307 on bolts are loose, the length of the template 231 can be adjusted. When the desired length is obtained, the nuts 307 are tightened on the bolts 305 to fix the template in place.

Cam guide means 309 are fixed to the sewing machine table 311. These guide means 309 comprise a guide pin 313 fastened to a bracket 315 which is fastened to table 311. The pin 313 has a small bottom cylindrical portion 317, which rides in groove portion 255, and a larger top cylindrical portion 319, which rides in groove portion 257, of template 231.

A support 325 for a collar holder 327 is carried by the second platform 281. The support 325 rides on the top surface of sewing machine table 311 and a bracket 329 connects it to second platform 281. The collar holder 327 is adapted to snap on to the support 325 in the proper position. To this end, a pair of recesses 331 are provided in the front face 333 of the support 325. The collar holder 327 has a pair of locating pins 335 projecting from its back wall 337 which fit into recesses 331. A spring-loaded ball detent mechanism 339 retains each pin in the recess. If desired, pressurized air can be directed through a line 341 and a pair of ports 343 passing through support 325 to push the holder 327 off the support 325 when desired. The holder 327 has a hinged cover 347 which clamps the collar plies 205, 207 to be sewn, against a base plate 349.

In operation, a collar 203 to be sewn is mounted in the holder 327 and the holder 327 is mounted in the support 325. When the holder is mounted in the support, the sewing machine needle 351 is located at either position A or position D (see FIG. 6) of the path 209 to be sewn, depending on the position of the first platform 261.

A master switch 353 on the sewing machine is then operated to actuate the second fluid-operated device 291 to move the second platform 281 and thus template 231 past pin 313 from position A on the template to position B as shown in FIG. 15*a*. As the second platform 281 begins to move it triggers a switch 355 mounted on the first platform 261 which switch initiates operation of the sewing machine. This switch can be adjusted in the direction of rails 283 so as to start sewing at different points along cam track A-B depending on the width of the collars. During movement of the second platform 281, the first platform 261, is free to float back and forth on its rails 263, thus accommodating the concave path A-B.

At position B, (FIG. 15*b*) suitable switch means stop operation of second device 291 and initiate operation of the first device 271 to move the first platform 261, and thus template 231 past pin 313 from corner position B to corner position C. The second platform 281 is free to float during this movement. At position C, (FIG. 15*c*) suitable switch means stop operation of the first device 271 and initiate operation of the second device 291 in a reverse direction to its first movement, to move the template from position C to D (FIG. 15*d*). Movement and sewing stop, the collar is now sewn, and the holder 327 is removed to be replaced by another holder holding another collar to be sewn. The new collar is sewn by moving in a reverse direction through the template groove to the direction moved in sewing the first collar. Thus pin 313 moves from D to C to B to A.

FIG. 16 illustrates one system for controlling the operation of the above apparatus. The system employs hydraulic fluid for the fluid-operated devices 271, 291 and pressurized air to control hydraulic fluid flow to and from the hydraulic operated devices. In this system each hydraulic device 271, 291 is provided with a pair of hydraulic valves. First hydraulic device 271 has a first hydraulic valve 401 connected to its front port 403 and a second hydraulic valve 405 connected to its back port 407. Second hydraulic device 291 has a first hydraulic valve 409 connected to its front port 411 and a second hydraulic valve 413 connected to its back port 415.

The system includes a hydraulic reservoir 417, a distributor 419 and a pump 421 for pumping hydraulic fluid from reservoir 417 to distributor 419 via a main feed line 423. A pressure gauge 425 can be provided in feed line 423. An overflow return line 427 leads from distributor 419 to the reservoir 417, and a return line 429 can also be provided from line 423 upstream of the pressure gauge 425. A first secondary feed line 431 leads from distributor 419 to both valves 401, 405 associated with first hydraulic device 271. A second, secondary feed line 433 leads from distributor 419 to both valves 409, 413 associated with second hydraulic device 291. Return lines 435, 437 connect valves 401, 405 respectively to return line 427. Return lines 439, 441 connect valves 409, 413 respectively to return line 427.

The hydraulic valves are operated by air pressure. A first air valve 443 is operatively connected to hydraulic valves 401, 405 by air lines 445, 447. A second air valve 449 is operatively connected to hydraulic valves 409, 413 by air lines 451, 453. Air line 455 connects first air valve 443 to the main air line 457 and air line 459 connects second air valve 449 to main air line 457. A third air valve 461 is provided in the system for operating the clutch 463 of the sewing machine needle bar 465. The third air valve 461 is connected to an air piston assembly 467 by air lines 469, 471. Piston assembly 467 operates clutch 463 to engage with the sewing machine motor 473 so as to operate the needle bar 465 to sew. Line 475 connects valve 461 with the main air line 457.

Air valve 443 has an exhaust line 477; air valve 449 has an exhaust line 479, and air valve 461 has an exhaust line 481. The three air valves 443, 449 and 461 are each operated by a pair of solenoids. Valve 443 has a pair of operating solenoids 483, 485; valve 449, a pair of solenoids 487, 489; and valve 461 a pair of solenoids 491, 493.

Figure 12:
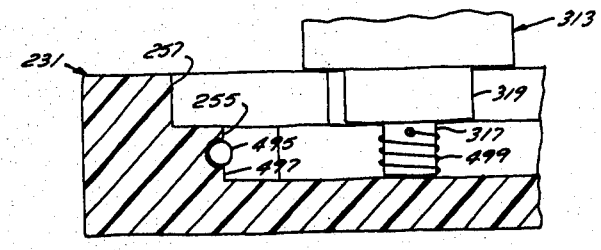
FIG. 12 is a cross-section view taken along line 12—12 of FIG. 10.

As previously mentioned, a master switch 353 is provided on the sewing machine for initiating operation of the apparatus. A sewing machine start switch 355 is mounted on the first platform 261 to be triggered by movement of the second platform 281. Switch means 357 at position B forms a first change switch. This switch is mounted in the corner B of the template groove 251 as will be described. Switch means 359 at position C forms a second change switch. This switch is mounted in corner C of the template groove. Both change switches 357, 359 are the same and as shown in FIG. 12, include a first electrical contact, such as a metal ball 495 positioned in the wall 497 of the lower groove portion 255 in each corner B, C. A wire 499 is wound about the lower portion 317 of pin 313 for making contact with the metal balls 495 as the pin 313 moves into the corners B, C of the groove. The ball 495 and wire 499 are electrically connected into the system by suitable leads (not shown). A first activating switch 501 is provided on the first platform 261 to be operated by the second platform 281 as the pin moves toward and away from the corners B, C. A second activating switch 503 is provided on the end of one of the rails 263 to be operated by the first platform 261 as the pin moves toward and away from corner C.

In operation, when master switch 353 is operated, solenoid 487 is activated to operate air valve 449, which via line 451, actuates valve 409 to direct fluid under pressure to front port 411 of device 291. This causes platform 281 to commence moving pin 313 from A to B. The device 291 vents via its rear port 415 and valve 413. As the platform 281 starts to move, it triggers switch 355 which, via solenoid 491 and air valve 461, causes clutch 463 to engage and commence sewing. At B, the activating switch 501 and change switch 357 are triggered to release solenoid 487 thereby allowing the cylinder device 291 to float and to activate solenoid 483 which via valve 443 and line 445 operates valve 405 to feed fluid under pressure to the rear port 407 of cylinder device 271. This causes platform 261 to move moving pin 313 from B to C. In moving to C, the device 291 floats due to the concave path and the floating action of table 281 resets activating switch 501. At C, the second change switch 359 and the reset activating switch 501 are triggered to release solenoid 483 and to activate solenoid 489. Solenoid 489, via valve 449 and line 453, actuates valve 413 to cause the platform 281 to move forward, moving pin 313 from C to D. In moving to D, switch 355 stops sewing. At D, the sewn collar is removed and a second collar is inserted. When master switch 353 is again operated solenoid 489 is released and solenoid 487 is activated as before to move platform 281, moving pin 313 from D to C. Switch 355 commences sewing as before. At C, activating switch 501 releases solenoid 487 as before, but change switch 359 activates solenoid 485 now instead of solenoid 483. This is due to activating switch 503 having been contacted by table 261 while previously moving from B to C, to effect a switch over. Solenoid 485 causes table 261 to move pin 313 from C to B. At B, change switch 357 and reset activating switch 501 release solenoid 485 and activate solenoid 489. Switch 503 meanwhile resets so that on the next collar, switches 357, 359 will activate and release solenoid 483 to move the table 261 moving pin 313 from B to A.

The embodiments of the invention in which an exclusive property or privilege is claimed are defined as follows:

1. An apparatus for use in substantially automatically sewing articles along a symmetrical, open-ended path comprising means for mounting each article on a support, and means for automatically moving the support to sew along the path from either end of the path to the other end.

2. An apparatus as claimed in claim 1, wherein the support moving means include a first platform mounted for movement along a straight line; and a second platform mounted for movement, on the first platform, along a straight line which is perpendicular to the first line; the support fixed to the second platform.

3. An apparatus as claimed in claim 2 including template means moving a cam surface corresponding to the path to be sewn, means for detachably mounting the template on the second platform, and a fixed cam member adjacent the cam surface.

4. An apparatus as claimed in claim 3 including a fluid-operated device to move the first platform in both directions in its straight line movement, and spring means to bias the second platform in one direction in its straight line movement to maintain the cam surface against the cam member.

5. An apparatus as claimed in claim 4 including means for adjusting the length of the template and means at one end of the template cooperating with the cam member to halt the movement of the first platform in one direction after sewing an article.

6. An apparatus as claimed in claim 3 including a first fluid-operated device to move the first platform in both direcions in its straight line movement, and a second fluid-operated device, mounted on the first platform perpendicular to the first device, to move the second platform in both directions in its straight line movement.

7. An apparatus as claimed in claim 6 wherein the cam surface on the template comprises a groove in its top surface, and the fixed cam member comprises a pin projecting into the groove.

8. An apparatus as claimed in claim 7 including at least one switch means in the groove where a substantial change of direction occurs, the switch means operable to initiate operation of one of the two fluid-operated devices while terminating operation of the other of the devices.

9. An apparatus for sewing an article in a predetermined pattern comprising a holder for the article to be sewn; sewing means adjacent the holder; a template of the pattern to be sewn; means connecting the template to the article holder; first means for moving the template in a first direction; second means for moving the template in a second direction perpendicular to the first direction; follower means for the template fixed to a frame; and control means on the template where a change of direction occurs for use in controlling the operation of the first and second moving means to move the template past the follower means in different directions.

10. An apparatus as claimed in claim 9 wherein the follower means contains first electrical contact means; the control means on the template comprising second electrical contact means at each location where a pronounced change of direction occurs; the first and second contact means cooperating to operate the first and second moving means when contact is made between them.

11. An apparatus as claimed in claim 9, wherein the template is adjustable in length.

12. An apparatus as claimed in claim 11, wherein the template comprises two plate members, means for slidably mounting the plate members for movement toward and away from each other, and cooperating interfitting means on the adjacent sides of the plate members.

13. An apparatus as claimed in claim 10, wherein the template has a follower groove with a narrow width at its bottom portion, and a wide width at its top portion; the follower means comprising a stepped pin for snugly fitting in both groove portions.

14. An apparatus as claimed in claim 13, wherein the bottom portion of the groove carries the second electrical contact means and the bottom portion of the pin carries the first electrical contact means.

15. An apparatus as claimed in claim 9, wherein the first and second moving means comprise first and second hydraulic piston assemblies, a pair of hydraulic valves for each piston assembly to control the flow of hydraulic fluid to and from each assembly from a source hydraulic fluid, an air valve to control each pair of hydraulic valves, and solenoid means operated by the controlling means for actuating the air valves.

* * * * *